US008739331B2

(12) United States Patent
Gillett et al.

(10) Patent No.: US 8,739,331 B2
(45) Date of Patent: Jun. 3, 2014

(54) CHANGER ASSEMBLY AND PLAYARD WITH STOW-AWAY CHANGER

(71) Applicants: Michael H. Gillett, Stowe, OH (US); Sharon A. Gillett, Stowe, OH (US); Jonathan M. Pacella, Coatesville, PA (US); Jonathan K. Mountz, Birdsboro, PA (US)

(72) Inventors: Michael H. Gillett, Stowe, OH (US); Sharon A. Gillett, Stowe, OH (US); Jonathan M. Pacella, Coatesville, PA (US); Jonathan K. Mountz, Birdsboro, PA (US)

(73) Assignee: Wonderland Nurserygoods Company Limited, Central (HK)

( * ) Notice: Subject to any disclaimer, the term of this patent is extended or adjusted under 35 U.S.C. 154(b) by 0 days.

(21) Appl. No.: 13/677,303

(22) Filed: Nov. 15, 2012

(65) Prior Publication Data

US 2013/0119333 A1 May 16, 2013

Related U.S. Application Data

(60) Provisional application No. 61/629,296, filed on Nov. 16, 2011.

(51) Int. Cl.
*A47D 7/00* (2006.01)

(52) U.S. Cl.
USPC ..... 5/93.1; 5/655

(58) Field of Classification Search
USPC ..... 5/93.1, 93.2, 95, 96, 97, 99.1, 100, 655; 108/65, 69, 77–82, 152
See application file for complete search history.

(56) References Cited

U.S. PATENT DOCUMENTS

| | | | | |
|---|---|---|---|---|
| 2,851,700 | A | 9/1958 | Denison | |
| 6,948,197 | B1 * | 9/2005 | Chen | 5/93.1 |
| 2006/0130237 | A1 * | 6/2006 | Clapper et al. | 5/655 |
| 2008/0098530 | A1 | 5/2008 | Chen | |
| 2008/0209631 | A1 * | 9/2008 | Thomas et al. | 5/99.1 |
| 2012/0005826 | A1 * | 1/2012 | Bickley | 5/93.1 |

FOREIGN PATENT DOCUMENTS

| | | | |
|---|---|---|---|
| GB | 2 382 522 | A | 6/2003 |
| WO | 2013003320 | A2 | 1/2013 |

* cited by examiner

*Primary Examiner* — Nicholas Polito
*Assistant Examiner* — Richard G Davis
(74) *Attorney, Agent, or Firm* — Winston Hsu; Scott Margo

(57) ABSTRACT

A changer assembly and a playard are disclosed. The changer assembly is adapted for installation on a skeleton of a playard and includes an attachment base and a changer frame. The attachment base includes a mount structure attached to the skeleton and a guiding structure connected to the mount structure and outwardly extended with respect to a circumferential side of the skeleton. The changer frame is rotatably and slidably connected to the guiding structure and detachably engaging with an upper side of the skeleton for being capable of moving from a first position above the upper side to a second position beside the circumferential side by disengaging from the upper side and rotating on and sliding along the guiding structure. Thereby, the playard equipped with the changer assembly needs no additional space outside the playard for storing the changer frame.

18 Claims, 8 Drawing Sheets

CHANGER ASSEMBLY AND PLAYARD WITH STOW-AWAY CHANGER

CROSS REFERENCE TO RELATED APPLICATIONS

This application claims the benefit of U.S. Provisional Application No. 61/629,296, which was filed on Nov. 16, 2011, and is incorporated herein by reference.

BACKGROUND OF THE INVENTION

1. Field of the Invention

The invention relates to a changer assembly and a playard with changer, and especially relates to a movable changer and a playard with stow-away changer.

2. Description of the Prior Art

Playards are used to contain and provide a safe environment for a child for sleeping or playing. Due to the widespread use of playards, considerable effort has been devoted to increase their versatility to caregivers. Some accessories that have been added to playards are changing tables (or "changers"), bassinets and newborn sleep areas (or "nappers"). Many playards currently on the market are sold with a changing station, allowing for convenient changing of an infant's diaper. When this changer is not in use, it is usually removed from the playard or moved to a storage position by the caregiver. There are also numerous methods used for moving the changer to a storage position when not in use, such as rotating the changer out of the way. Most of the current methods require additional space around the outside of the playard for that movement.

SUMMARY OF THE INVENTION

An objective of the invention is to provide a changer assembly adapted for installation on a skeleton of a playard. The changer assembly uses a sliding mechanism to store a changer frame without any additional space outside the playard.

In order to reduce the space for the storage operation of a changer frame, as will be seen more clearly from the detailed description following below, according to one embodiment, the changer assembly includes an attachment base and a changer frame. The attachment base includes a mount structure attached to the skeleton and a guiding structure connected to the mount structure and outwardly extended with respect to a circumferential side of the skeleton. The changer frame is rotatably and slidably connected to the guiding structure and detachably engaging with an upper side of the skeleton for being capable of moving from a first position above the upper side to a second position beside the circumferential side by disengaging from the upper side and rotating on and sliding along the guiding structure.

Preferably, the guiding structure includes a protrusion. The changer frame includes a rail rotatably and slidably connected to the protrusion.

Preferably, the rail has a first end and a second end capable of alternatively rotating and sliding to the protrusion for rendering the changer frame moved between the first position and the second position.

Preferably, the changer frame further includes a panel connected to the first end for selectively being supported on the upper side in cooperation with the second end rotating and sliding to the protrusion or being supported on the protrusion and/or the mount structure in cooperation with the first end rotating and sliding to the protrusion.

Preferably, the changer frame includes a snap locking mechanism operable for detachably engaging with the upper side.

Preferably, the changer frame further includes a panel on which the snap locking mechanism is assembled for being supported on the upper side in cooperation with the snap locking mechanism engaging with the upper side.

Preferably, the snap locking mechanism includes a latch for detachably engaging with the upper side and an actuator for driving the latch to disengage from the upper side. The latch is engaged with the upper side when the changer frame is at the first position, and is disengage from the upper side when the changer frame is at the second position.

Preferably, the latch is spring-biased towards a latched orientation.

Preferably, a motion of the latch is a sliding motion or a pivoting motion.

Preferably, the snap locking mechanism further includes a linkage connecting the latch and the actuator for translating an operation of the actuator to a disengagement of the latch.

Preferably, the attachment base further includes a tray connected to the mount structure. The guiding structure and the changer frame are arranged between the tray and the mount structure.

Another objective of the invention is to provide a playard with changer. Similarly, the playard uses a sliding mechanism to store a changer frame without any additional space outside the playard.

According to one embodiment, the playard includes a skeleton including an upper side and a circumferential side, and the above-mentioned changer assembly.

Preferably, the mount structure includes a pin. The skeleton includes a socket formed on the upper side. The pin is inserted into the socket.

According to another embodiment, the playard includes a skeleton including an upper side and a circumferential side, and the above-mentioned changer assembly, wherein the skeleton further includes a recess formed on the upper side for being detachably engaged with the latch, and the latch is engaged with the recess when the changer frame is at the first position and disengaged from the recess when the changer frame is at the second position.

Compared with the prior art, when the changer frame is not in use, the changer frame can be stored directly between the skeleton and the attachment base without requiring any additional space around the outside of the playard for storage operation, which facilitates operation and storage of the changer frame to caregivers. Further, it also facilitates the deployment of the playard without interfering with other equipment.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
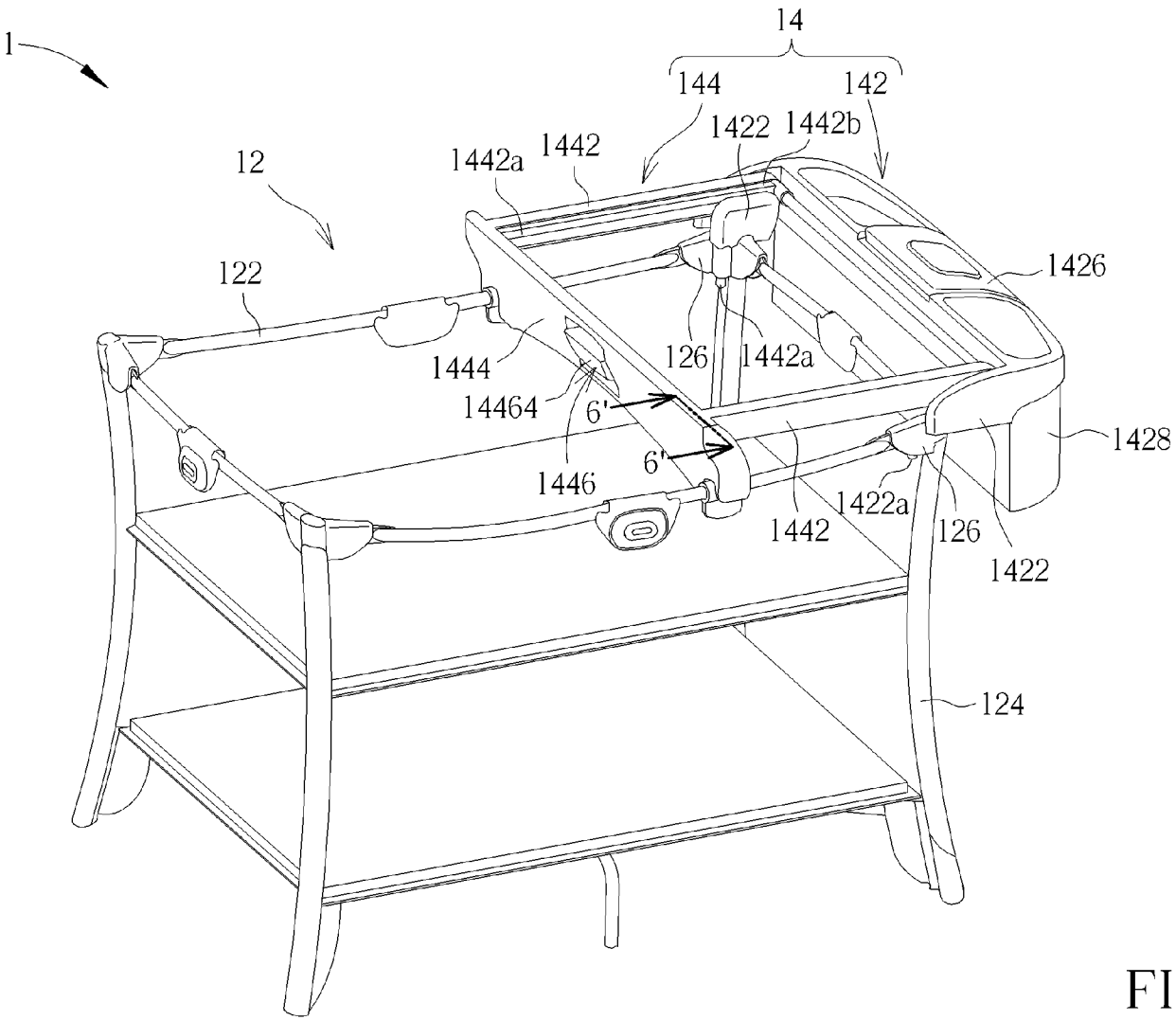
FIG. 1 is a perspective view of a playard with stow-away changer according to an embodiment of the invention.
Figure 2:
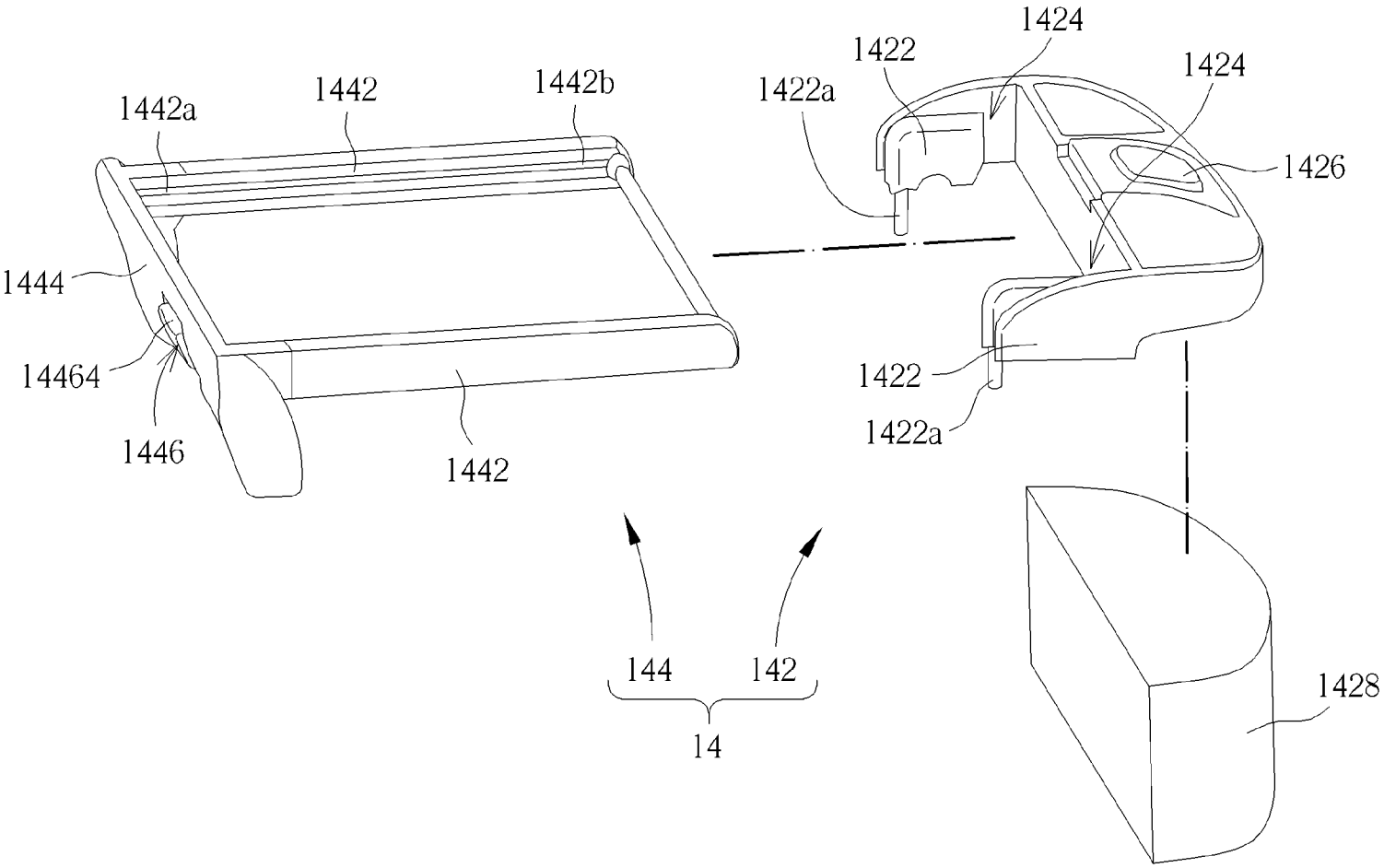
FIG. 2 is a partially exploded view of a changer assembly of the playard in FIG. 1.
Figure 3:
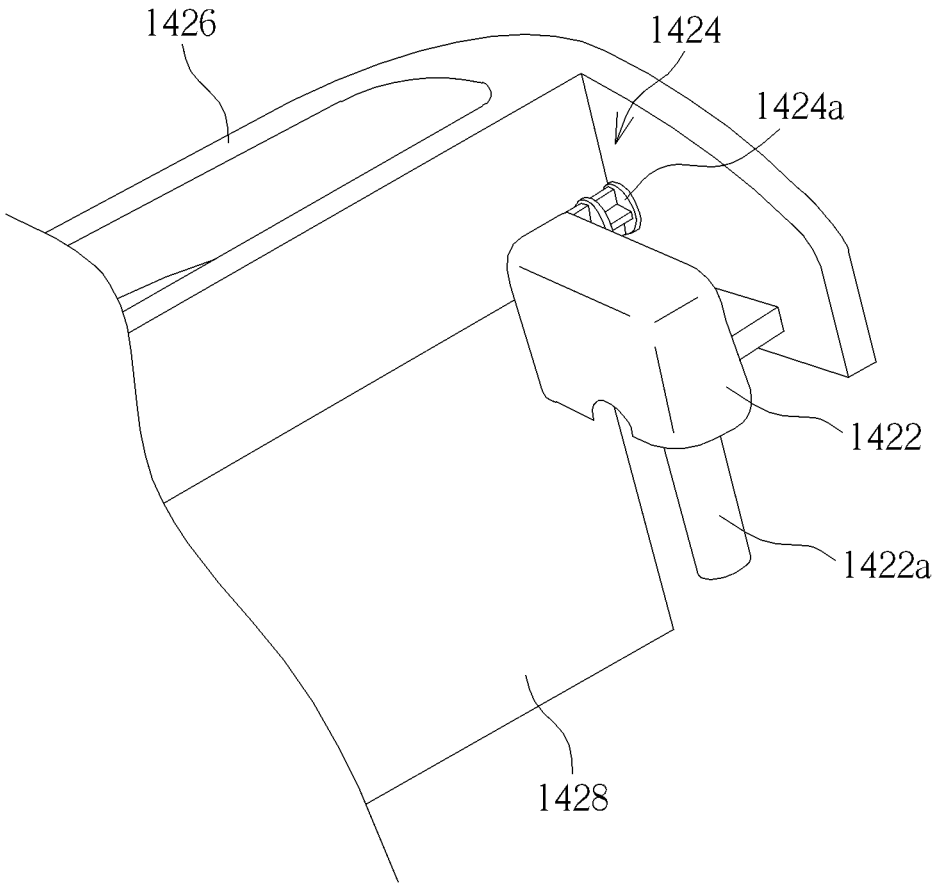
FIG. 3 is an enlarged view of a guiding structure of the changer assembly in FIG. 2.

Please refer to FIGS. 1 through 3, which are a perspective view of a playard 1 with stow-away changer according to an embodiment of the invention, a partially exploded view of a changer assembly 14 of the playard 1 in FIG. 1 and an enlarged view of a guiding structure 1424 of the changer assembly 14 in FIG. 2, respectively. The playard 1 includes a skeleton 12 and the changer assembly 14. The skeleton 12 includes an upper side 122 and a circumferential side 124. The changer assembly 14 includes an attachment base 142 and a changer frame 144. The attachment base 142 includes a mount structure 1422 attached to the skeleton 12 and the guiding structure 1424 connected to the mount structure 1422 and outwardly extended with respect to the circumferential side 124 of the skeleton 12. The changer frame 144 is rotatably and slidably connected to the guiding structure 1424 and detachably engaging with the upper side 122 of the skeleton 12 for being capable of moving from a first position (shown as FIG. 1) above the upper side 122 to a second position (shown as FIG. 8, which is a perspective view of the playard 1 in FIG. 1 when the changer frame 144 is located between the attachment base 142 and the skeleton 12) beside the circumferential side 124 by disengaging from the upper side 122 and rotating on and sliding along the guiding structure 1424. The storage operation for the changer frame 144 will be described in the following in details. It is added that for simple illustration of the playard 1, a plate member, which is disposed on the changer frame 144 for caregivers to change diapers of infants thereon, and a fabric body, which connects or wraps around the skeleton 12, are not shown in FIG. 1 and following figures.

Figure 4:
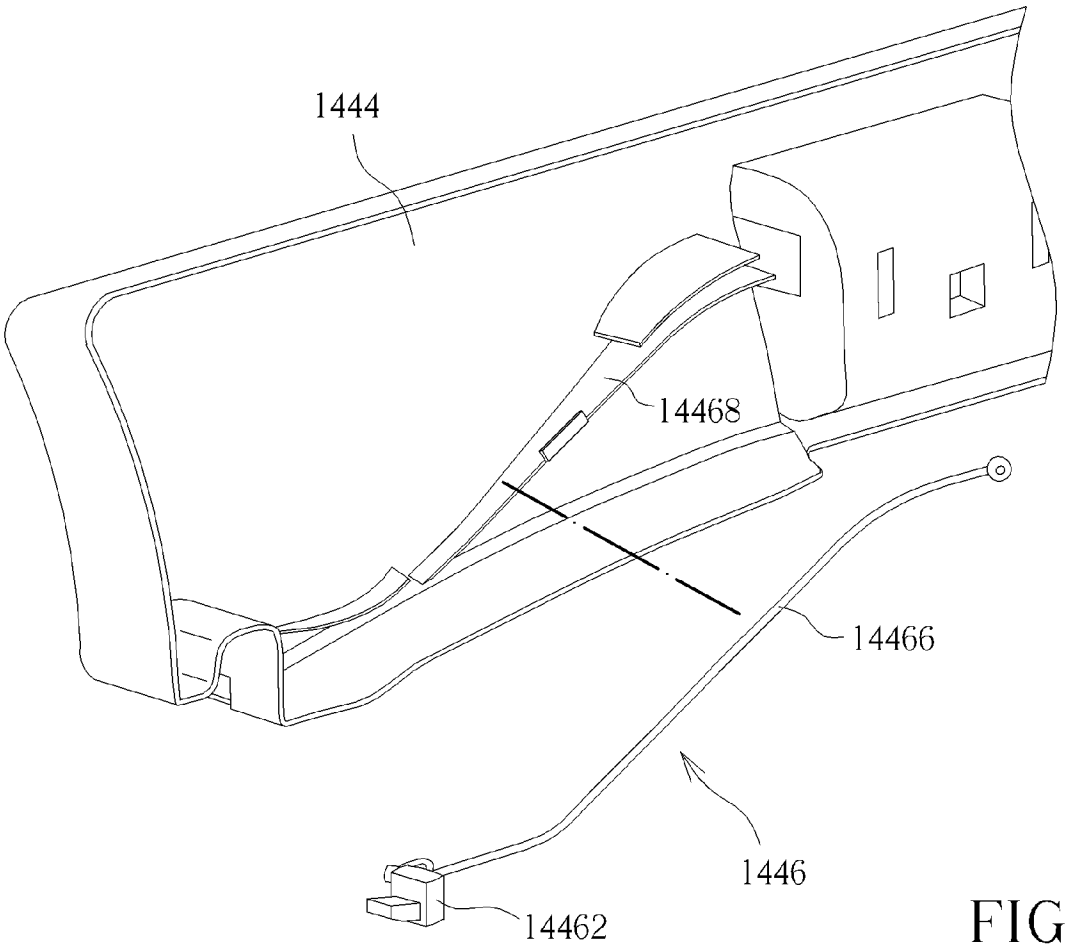
FIG. 4 is an interior view of a panel of the changer assembly in FIG. 2.

Please also refer to FIGS. 2 through 4. FIG. 4 is an interior view of a panel 1444 of the changer frame 144. The attachment base 142 also includes a tray 1426 connected to the mount structure 1422 and a reservoir 1428 connected to the tray 1426. The guiding structure 1424 and a portion of the changer frame 144 are arranged between the mount structure 1422 and the tray 1426 (and the reservoir 1428). The mount structure 1422 includes two pins 1422*a*, and the skeleton 12 includes two sockets 126 formed on the upper side 122 correspondingly. The mount structure 1422 is attached to the skeleton 12 by inserting the pins 1422*a* to the corresponding sockets 126.

The changer frame 144 includes two rails 1442 and the panel 1444. The rail 1442 has a first end 1442*a* and a second end 1442*b*. The panel 1444 is connected to the first ends 1442*a*. The guiding structure 1424 includes two protrusions 1424*a*. The rails 1442 are rotatably and slidably connected to the protrusions 1424*a* correspondingly so as to be capable of alternatively rotating and sliding along the protrusions 1424*a* for rendering the changer frame 144 moved between the first position (shown as FIG. 1) and the second position (shown as FIG. 8). The panel 1444 can selectively be supported on the upper side 122 in cooperation with the second end 1442*b* rotating and sliding to the protrusions 1424*a* (shown as FIG. 1) or be supported on the protrusions 1424*a* and/or the mount structure 1422 in cooperation with the first end 1442*a* rotating and sliding to the protrusions 1424*a* (shown as FIG. 8).

The changer frame 144 also includes a snap locking mechanism 1446 assembled on the panel 1444 and operable for detachably engaging with the upper side 122. The panel 1444 can be supported on the upper side 122 more stable in cooperation with the snap locking mechanism 1446 engaging with the upper side 122. The snap locking mechanism 1446 includes a latch 14462 for detachably engaging with the upper side 122, an actuator 14464 for driving the latch 14462 to disengage from the upper side 122, and a linkage 14466 connecting the latch 14462 and the actuator 14464 for translating an operation of the actuator 14464 to a disengagement of the latch 14462. In addition, the snap locking mechanism 1446 further includes a passage 14468 in which the linkage 14466 is accommodated, for improving the stability of the translating.

Figure 5:
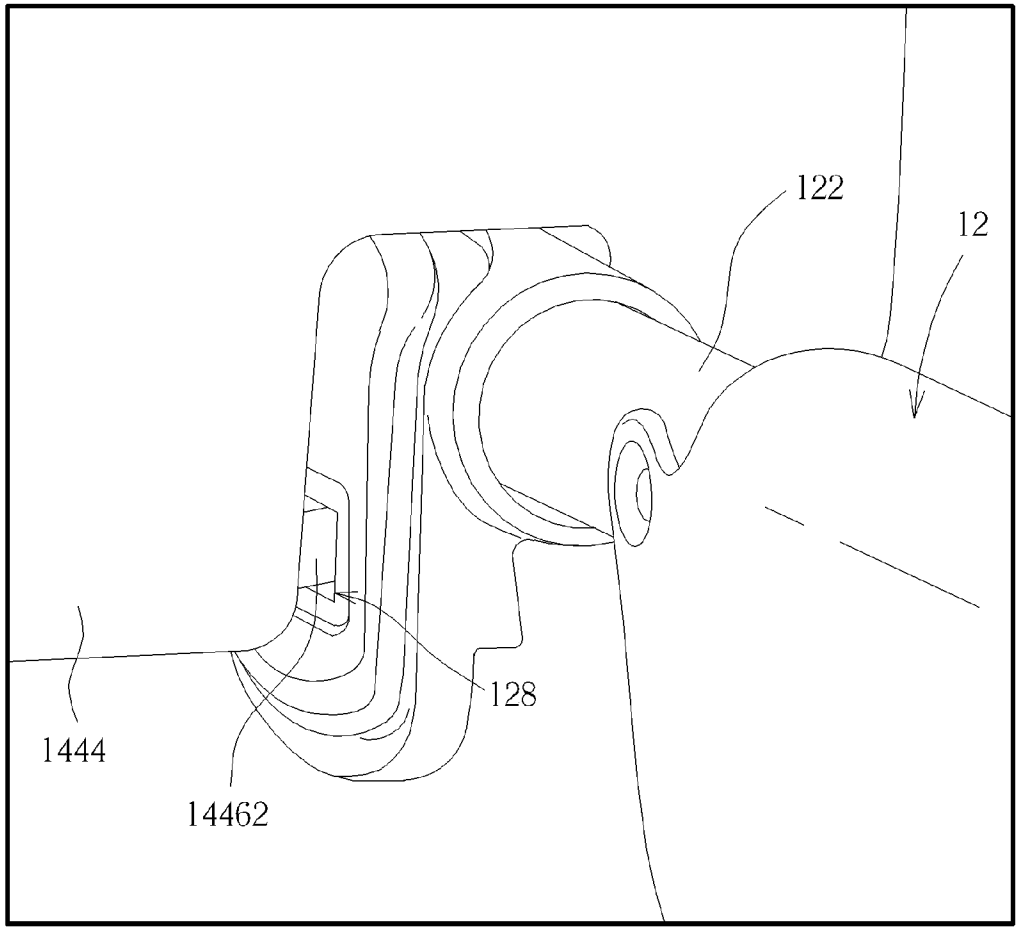
FIG. 5 is an enlarged view of a part of the playard in FIG. 1 where the panel of the changer assembly is disposed above an upper side of a skeleton of the playard.
Figure 6:
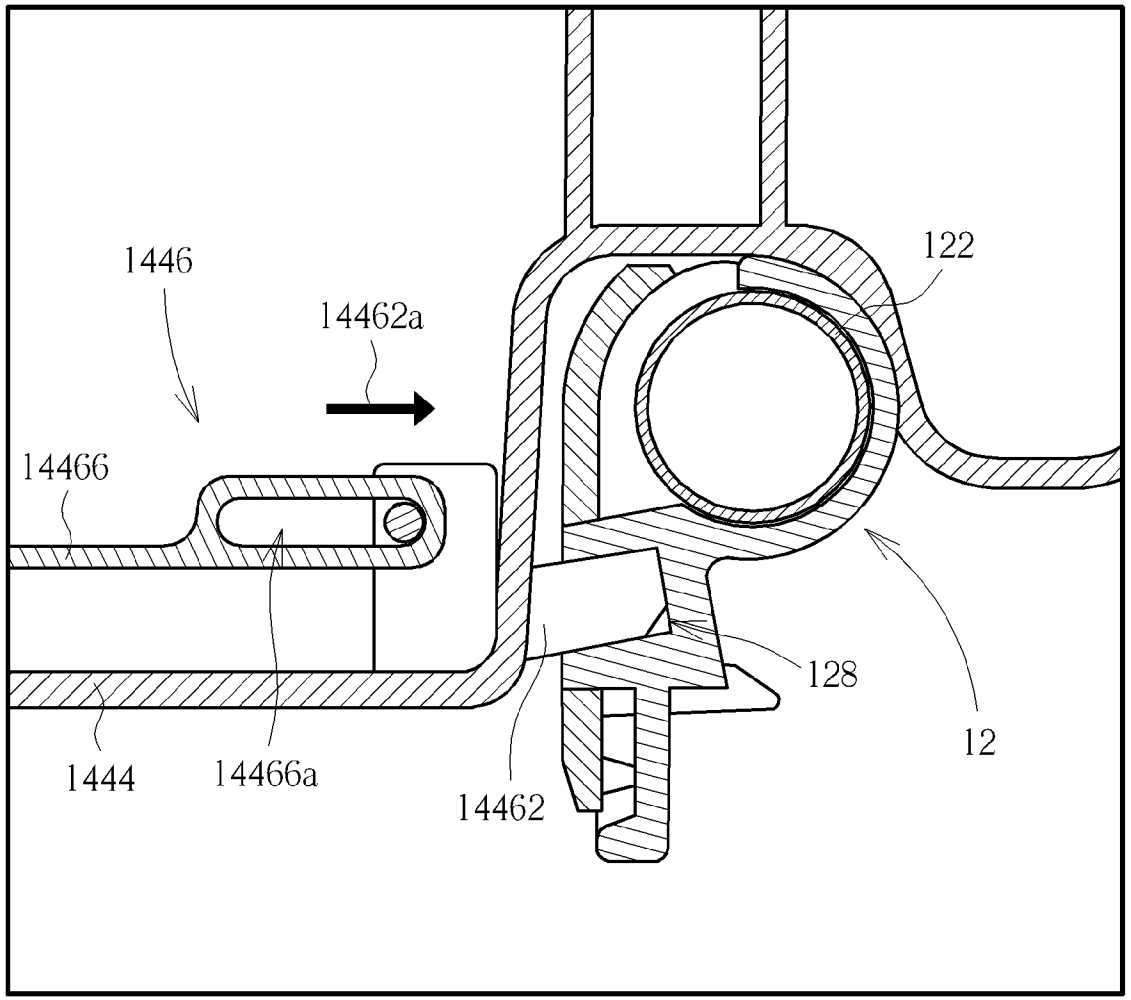
FIG. 6 is a front sectional view along the line 6'-6' in FIG. 1.

Please also refer to FIG. 5 and FIG. 6. FIG. 5 is an enlarged view of a part of the playard 1 in FIG. 1 where the panel 1444 of the changer frame 144 is disposed above the upper side 122 of the skeleton 12. FIG. 6 is a front sectional view along the line 6'-6' in FIG. 1. The skeleton 12 further includes a recess 128 formed on the upper side 122 for being detachably engaged with the latch 14462. When the changer frame 144 is at the first position as shown in FIG. 1, the changer frame 144 is supported on the upper side 122, and the latch 14462 is engaged with the recess 128 on the upper side 122.

In the embodiment, the latch 14462 is spring-biased towards a latched orientation 14462*a* (indicated by an arrow) by such as a spring, so that the latch 14462 can be automatically and passively engaged with the recess 128 when the changer frame 144 is to be located at the first position for use. Furthermore, the spring-biased design is also conducive to enhancement of the stability of the engagement of the latch 14462 with the recess 128. In addition, the motion of the latch 14462 is a sliding motion; in practice, it can be a pivoting motion. The linkage 14466 has a relief slot 14466*a* into which the latch 14462 is inserted.

Figure 7:
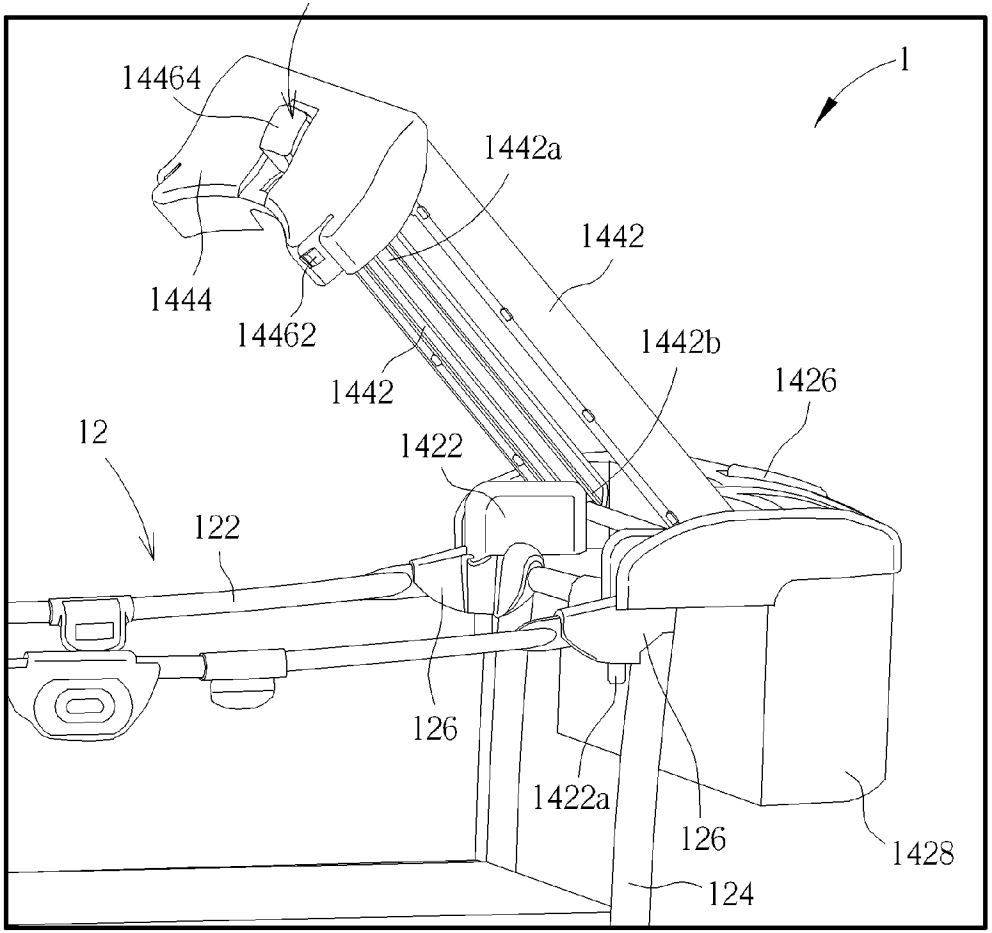
FIG. 7 is a perspective view of the playard in FIG. 1 when a changer frame of the changer assembly is rotated upward.
Figure 8:
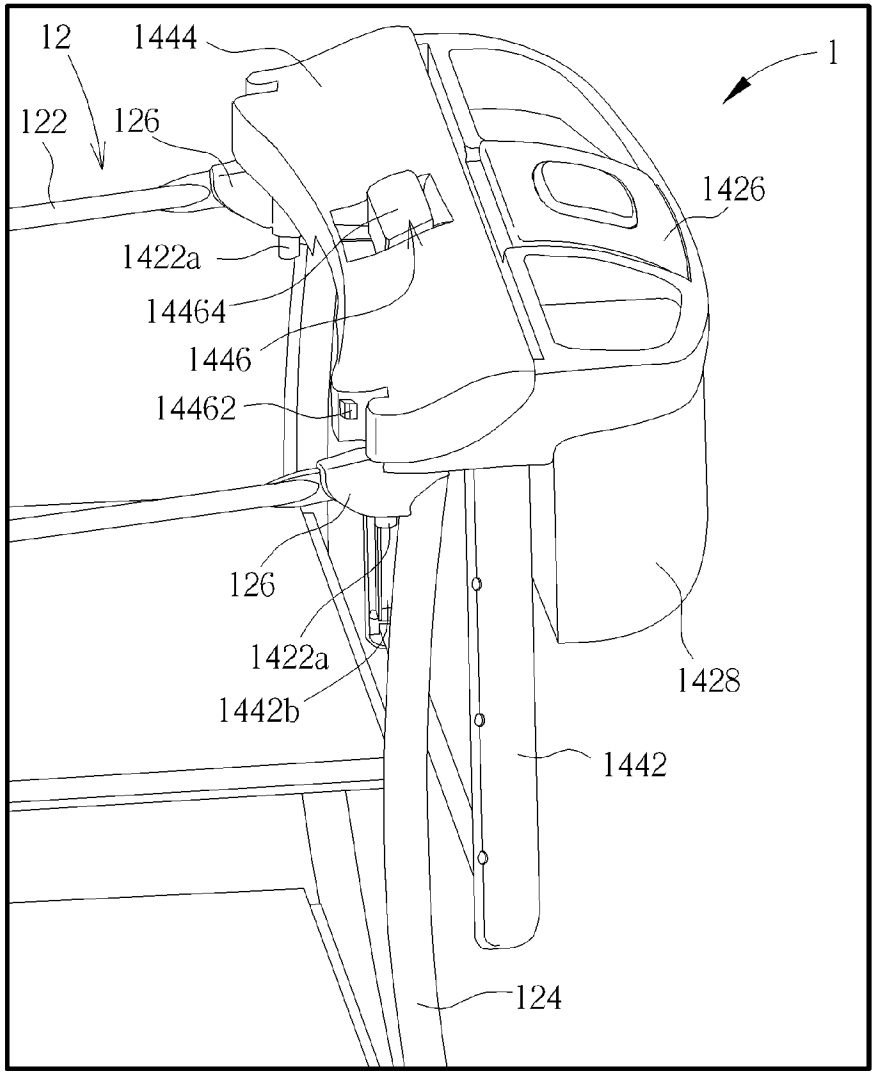
FIG. 8 is a perspective view of the playard in FIG. 1 when the changer frame is located between the attachment base and the skeleton.

Please also refer to FIG. 7 and FIG. 8. FIG. 7 is a perspective view of the playard 1 when the changer frame 144 is rotated upward. FIG. 8 is a perspective view of the playard 1 when the changer frame 144 is located between the tray 1426 and the reservoir 1428 of the attachment base 142 and the circumferential side 124 of the skeleton 12. When the changer frame 144 is required to be stored, the actuator 14464 is operated to drive the latch 1462 to disengage from the recess 128 on the supper side 122. Then, the changer frame 144 can be lifted upward and rotated about the protrusions 1424*a* of the guiding structure 1424 with the second ends 1442*b* and slid by the rails 1442 along the protrusions 1424*a* until the first ends 1442*a* slides to and approached the protrusions 1424*a* and the panel 1444 is supported on the protrusions 1424*a* and/or the mount structure 1422. Thereby, the changer frame 144 is located between the tray 1426 and the reservoir 1428 of the attachment base 142 and the circumferential side 124 of the skeleton 12 for storage, i.e. at the second position.

On the contrary, when the changer frame 144 is required to be used, the changer frame 144 can be lifted upward in cooperation with the rails 1442 sliding along the protrusions 1424*a* until the second end 1442*b* approaches the protrusions 1424*a*. Then, the changer frame 144 can be rotated downward about the protrusions 1424*a* until the panel 1444 is supported on the upper side 122. At the meantime, the latch 14462 is engaged with the recess 128, so that the panel 1444 is supported on the upper side 122 firmly. Thereby, the changer frame 144 is located at the first position for use.

It is added that, in the embodiment, the changer assembly 14 is structurally symmetrical, so the rails 1442 and the protrusions 1424*a* are disposed in pairs for stable structure; however, the invention is not limited thereto. Logically, one rail 1442 in cooperation with one protrusion 1424*a* also can perform the invention.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A changer assembly adapted for installation on a skeleton of a playard, the changer assembly comprising:

an attachment base including a mount structure attached to the skeleton and a guiding structure connected to the mount structure and outwardly extended with respect to a circumferential side of the skeleton, the guiding structure including a protrusion; and a changer frame rotatably and slidably connected to the guiding structure and detachably engaging with an upper side of the skeleton for being capable of moving from a first position above the upper side to a second position beside the circumferential side by disengaging from the upper side and rotating on and sliding along the guiding structure, the changer frame including a rail rotatably and slidably connected to the protrusion, the rail having a first end and a second end so as to be capable of alternatively rotating and sliding along the protrusion for rendering the changer frame moved between the first position and the second position, the changer frame further including a panel connected to the first end for selectively being supported on the upper side in cooperation with the second end rotating and sliding to the protrusion or being supported on the protrusion and/or the mount structure in cooperation with the first end rotating and sliding to the protrusion;

wherein when the changer frame moves from the first position to the second position, the panel rotates upward about the protrusion with the second end, and the rail slides downward along the protrusion until the first end approaches the protrusion and the panel is supported on the protrusion and/or the mount structure, and when the changer frame moves from the second position to the first position, the panel lifts upward and the rail slides along the protrusion until the second end approaches the protrusion, and the panel rotates downward about the protrusion with the second end until the panel is supported on the upper side.

2. The changer assembly of claim 1, wherein the changer frame includes a snap locking mechanism operable for detachably engaging with the upper side.

3. The changer assembly of claim 2, wherein the changer frame further includes a panel on which the snap locking mechanism is assembled for being supported on the upper side in cooperation with the snap locking mechanism engaging with the upper side.

4. The changer assembly of claim 2, wherein the snap locking mechanism includes a latch for detachably engaging with the upper side and an actuator for driving the latch to disengage from the upper side, and the latch is engaged with the upper side when the changer frame is at the first position and disengaged from the upper side when the changer frame is at the second position.

5. The changer assembly of claim 4, wherein the latch is spring-biased towards a latched orientation.

6. The changer assembly of claim 4, wherein a motion of the latch is a sliding motion or a pivoting motion.

7. The changer assembly of claim 4, wherein the snap locking mechanism further includes a linkage connecting the latch and the actuator for translating an operation of the actuator to a disengagement of the latch.

8. The changer assembly of claim 1, wherein the attachment base further includes a tray connected to the mount structure, and the guiding structure and the changer frame are arranged between the tray and the mount structure.

9. A playard, comprising:

a skeleton including an upper side and a circumferential side; and a changer assembly comprising:

an attachment base including a mount structure attached to the skeleton and a guiding structure connected to the mount structure and outwardly extended with respect to a circumferential side of the skeleton, the guiding structure including a protrusion; and a changer frame rotatably and slidably connected to the guiding structure and detachably engaging with an upper side of the skeleton for being capable of moving from a first position above the upper side to a second position beside the circumferential side by disengaging from the upper side and rotating on and sliding along the guiding structure, the changer frame including a rail rotatably and slidably connected to the protrusion, the rail having a first end and a second end so as to be capable of alternatively rotating and sliding along the protrusion for rendering the changer frame moved between the first position and the second position, the changer frame further including a panel connected to the first end for selectively being supported on the upper side in cooperation with the second end rotating and sliding to the protrusion or being supported on the protrusion and/or the mount structure in cooperation with the first end rotating and sliding to the protrusion;

wherein when the changer frame moves from the first position to the second position, the panel rotates upward about the protrusion with the second end, and the rail slides downward along the protrusion until the first end approaches the protrusion and the panel is supported on the protrusion and/or the mount structure, and when the changer frame moves from the second position to the first position, the panel lifts upward and the rail slides along the protrusion until the second end approaches the protrusion, and the panel rotates downward about the protrusion with the second end until the panel is supported on the upper side.

10. The playard of claim 9, wherein the changer frame includes a snap locking mechanism operable for detachably engaging with the upper side.

11. The playard of claim 10, wherein the changer frame further includes a panel on which the snap locking mechanism is assembled for being supported on the upper side in cooperation with the snap locking mechanism engaging with the upper side.

12. The playard of claim 10, wherein the snap locking mechanism includes a latch for detachably engaging with the upper side and an actuator for driving the latch to disengage from the upper side, and the latch is engaged with the upper side when the changer frame is at the first position and disengaged from the upper side when the changer frame is at the second position.

13. The playard of claim 12, wherein the latch is spring-biased towards a latched orientation.

14. The playard of claim 12, wherein a motion of the latch is a sliding motion or a pivoting motion.

15. The playard of claim 12, wherein the snap locking mechanism further includes a linkage connecting the latch and the actuator for translating an operation of the actuator to a disengagement of the latch.

16. The playard of claim 9, wherein the attachment base further includes a tray connected to the mount structure, and the guiding structure and the changer frame are arranged between the tray and the mount structure.

17. The playard of claim 9, wherein the mount structure includes a pin, the skeleton includes a socket formed on the upper side, and the pin is inserted into the socket.

18. A playard, comprising:

a skeleton including an upper side and a circumferential side; and a changer assembly of claim 4, wherein the skeleton further includes a recess formed on the upper side for being detachably engaged with the latch, and the latch is engaged with the recess when the changer frame is at the first position and disengaged from the recess when the changer frame is at the second position.

* * * * *